United States Patent [19]

Day et al.

[11] 4,334,476

[45] Jun. 15, 1982

[54] PRIMER CUP

[75] Inventors: John T. Day, Sandy; Lex L. Udy, Holladay, both of Utah

[73] Assignee: Mining Services International Corporation, Salt Lake City, Utah

[21] Appl. No.: 165,431

[22] Filed: Jul. 2, 1980

[51] Int. Cl.[3] ..... C06C 5/04

[52] U.S. Cl. ..... 102/275.7; 102/275.12; 102/331; 102/466

[58] Field of Search ..... 102/204, 205, 317, 322, 102/331, 332, 464–466, 202.14, 275.7, 275.12

[56] References Cited

U.S. PATENT DOCUMENTS

| | | | |
|---|---|---|---|
| 3,183,836 | 5/1965 | Griffith | 102/331 |
| 3,212,438 | 10/1965 | Lawrence | 102/332 |
| 3,359,903 | 12/1967 | Sobolenski | 102/466 |
| 3,507,218 | 4/1970 | Walker et al. | 102/331 |
| 3,604,353 | 9/1971 | Newman | 102/332 |
| 3,678,858 | 7/1972 | Herter et al. | 102/466 |
| 3,760,729 | 9/1973 | Freeman | 102/466 X |
| 3,789,760 | 2/1974 | Griffith | 102/331 |
| 4,037,536 | 7/1977 | Griffith | 102/331 |
| 4,202,270 | 5/1980 | Luther et al. | 102/464 |

FOREIGN PATENT DOCUMENTS

| | | | |
|---|---|---|---|
| 197309 | 4/1923 | United Kingdom | 102/275.12 |

*Primary Examiner*—Peter A. Nelson

*Attorney, Agent, or Firm*—H. Ross Workman; Allen R. Jensen; Drew S. Hamilton

[57] ABSTRACT

A cylindrical primer cup having a top end which may be sealed so as to safely contain granular or liquid explosive matter is disclosed. A cylindrical conduit extends in a straight path through the cup, providing an opening at either end permitting through-passage of detonating cord or blasting caps. The cylindrical conduit additionally has a fixed diameter throughout, facilitating its travel along a detonating cord. A frustoconical conduit extends well within the primer cup for the placement and frictional retention of blasting caps therein. The sidewalls of the two conduits are relatively thin to provide for easier primer detonation. Symmetrically placed columnar-shaped ribs provide longitudinal structural support for the cylindrical conduit.

32 Claims, 8 Drawing Figures

PRIMER CUP

BACKGROUND

1. Field of the Invention

The present invention relates to primer cups and more particularly to primer cups useful with liquid or gelled blasting agents.

2. The Prior Art

It is well-known that ammonium nitrate-fuel oil combinations (ANFO) are comparatively inexpensive and effective blasting agents. However, ANFO is characteristically low in sensitivity and can be initiated only with an initiating explosion having a high detonation pressure. In recent years, water gels, slurries, and emulsions have been developed as blasting agents and are now widely used. However, these blasting agents, like ANFO, are low in sensitivity and historically have developed low detonation pressures. Accordingly, water gels, slurries, and emulsions require a primer and/or booster to initiate and propagate detonation. Thus, to initiate a blasting agent such as ANFO, water gels, and the like, it is common to first explode a primer or booster, having a high detonation pressure, in close proximity to the blasting agent.

In the past, solid explosives such as TNT, PETN, and Pentolite have been the preferred material for primers because of the high detonation pressure which they develop. Solid materials are well recognized to be both expensive and precarious. Because solid primer materials are precarious, there is undesirable hazard in handling, storing, and using the same.

Historically, solid primer materials have been formed into required shapes by casting them in cups. These cups are then used for the storage and handling of the more hazardous solid primer materials, and are referred to as primer cups.

Most recently, aqueous compositions developing sufficient detonation pressure for use as primers and boosters have been discovered. Conventional solid material-receiving primer cups have, however, been found inadequate for use with liquid and/or gelled aqueous explosives. In the past, primer cups have been designed for use with non-liquid primer material at ambient temperatures. Thus, conventional primer cups have not provided structure for complete sealing of the cup itself to secure the aqueous explosive therein.

Solid primers have been formed with an axial passage which permitted the through-insertion of detonators such as detonating cord or blasting caps. In primers made of solid materials, the passage is typically directly through the solid cast explosive. Thus, direct contact between this primer and the detonator within the passage is made possible. A problem is experienced in this regard when using aqueous explosives as primers, since a conventional primer cup cannot provide for the retention of aqueous explosives and yet have a through-passage permitting insertion and direct contact of the detonator to the aqueous explosive. Further, when moisture contacts certain primers used as nitromethane formulations or dynamite formulations, it renders them ineffective as blasting agents. Although primer cups are often lowered into water environments, conventional primer cups have been unable to provide for the exclusion of moisture from outside sources and yet have a through-passage permitting insertion and direct contact of the detonator to the moisture sensitive explosive.

In the past, some primer cups have permitted the detonator to be affixed external to the cup. These primer cups are particularly useful for containing such primers as granular TNT. However, the wall separating the detonator from the primer cup contents constitutes an additional barrier which the detonator explosion must penetrate before the primer material can be exploded. In order to overcome the detonation barrier, a high energy detonating cord must be used and/or the primer material must be made dangerously sensitive. This problem becomes even more acute when aqueous primers are utilized.

Still another problem among prior art primer cups is experienced while lowering them into the borehole. In practice, a borehole is often provided with several separate levels of explosive material. In these instances, it is desirable to place a primer for each of the separate levels of explosive material. To accomplish this, a primer is situated on a length of detonating cord and placed near the bottom of a borehole. A quantity of blasting agent is then placed into the borehole around the primer. Thereafter, another primer is dropped down along the same detonating cord. More specifically, the detonating cord is extended through the passage in the primer cup, and the cup is then permitted to descend the borehole along the cord until it rests upon the blasting agent previously placed therein. After several charges of blasting agent are in place and primed, the same detonating cord can be used to explode all the primers essentially simultaneously.

Some of the primer cups utilized in the past have been designed such that the passage through which the detonating cord passes is tapered from a wider opening at its lower end to a narrower opening at its top end. This tapering avoids problems in the molding process, but has resulted in difficulty in lowering the primer cups down the detonating cord. These primer cups often become lodged on the detonating cord or against the side of the borehole as a result of the draft of the passage in the cup. Further, debris upon the detonating cord may collect within the tapered passage causing the cup to hang up along the cord.

An additional problem is experienced if the passage through which the detonating cord passes does not extend through the center of the primer cup. In that case, the first primer cups dropped along the detonating cord may cause twisting and kinking in the detonating cord so that subsequent cups dropped along the detonating cord become entangled or stopped at the kinked portion.

It would, therefore, be a significant contribution to the prior art to provide a primer cup which may be sealed to provide easier handling of aqueous explosives, and to prevent moisture contamination of moisture sensitive explosives. It would also be an important contribution for such a cup to be structurally sound while providing a means by which relatively lower strength detonating cords or blasting caps could be used to produce explosions effectively penetrating the primer cup walls to initiate the explosion of the contained aqueous primer material. It would additionally be desirable to provide a primer cup which could be reliably lowered down a detonating cord with the substantial elimination of jamming due to the draft of the cup passage or debris on the cord.

BRIEF SUMMARY AND OBJECTS OF THE INVENTION

The present invention comprises a cylindrical primer cup having a top which is sealed so as to safely contain aqueous or liquid explosive matter. A hollow conduit extends through the sealed primer cup and provides an opening at either end through which a detonating cord, blasting cap, or the like may be passed. The conduit is straight in configuration and has a constant diameter along its entire length to permit its trouble-free travel along detonating cords. The wall of this conduit is relatively thin in order to facilitate easier primer detonation. Structural strength is provided for the pass-through conduit by reinforcing structure to absorb loading experienced during the moulding process, or during attachment of the top and/or during movement of the cup over detonating cord or the like.

In a preferred embodiment, a second conduit extends inward through a substantial portion of the primer cup, and is positioned parallel to the pass-through conduit described above. The walls of the second conduit are similar in thickness to those of the first and are shaped so as to frictionally retain a blasting cap. The second conduit may be positioned within the primer cup so as to avoid contact with any wall, thus permitting more complete exposure to the explosive contents of the primer cup.

Accordingly, it is a primary object of the present invention to provide an improved primer cup and method of assembly of same.

It is another primary object of the present invention to provide an improved primer cup which may be lowered along a detonating cord while experiencing neither jamming due to swinging, nor appreciable collection of debris either from that cord or from the surrounding environment.

It is another primary object of the present invention to provide an improved primer cup which permits the use of relatively low energy detonating cords or blasting caps for initiating detonation of the contained low sensitivity primer material.

It is still another object of the present invention to provide an improved primer cup which provides structural strength to a thin walled pass-through conduit while permitting the effective use of low energy detonating cords and blasting caps.

It is still a further object of this invention to provide an improved primer cup having an additional thin walled shaft into which a blasting cap may be securely fitted and retained, permitting its use for detonating the contained primer material.

It is an additional object of the present invention to provide an improved primer cup which provides structure for the safe and effective use of fluid primer materials and/or moisture sensitive primer materials for initiating detonation of explosives in borehole blasting environments.

These and other objects and features of the present invention will become more fully apparent from the following description and appended claims taken in conjunction with the accompanying drawings.

DETAILED DESCRIPTION OF THE PREFERRED EMBODIMENTS

The invention is best understood by reference to the Figures wherein like parts are designated with like numerals throughout.

Figure 1:
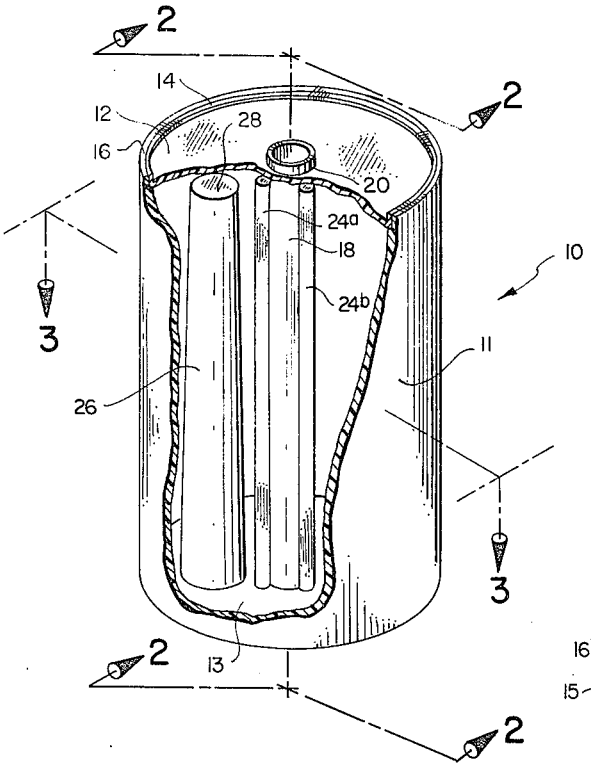
FIG. 1 is a fragmentary perspective view of a presently preferred embodiment of the primer cup.

FIG. 1 illustrates one preferred embodiment of the primer cup. A container generally designated as 10 has substantially cylindrical walls 11 and is joined at its lower end to base 13. The wall 11 and base 13 constitute the cup into which the explosive primer material is placed.

There are numerous types of explosive primer materials which are feasible for use in initiating detonation of blasting agents in boreholes. Some of these have physical characteristics which have limited or prevented their use in boreholes in the past. Particularly these primers include agents having granular, or liquid characteristics. Some primer materials are also adversely affected by contact with moisture. Primer cup 10 provides for the safe and effective use of these primer materials as well as many of the other types of primer agents commonly used in borehole blasting environments.

Figure 2:
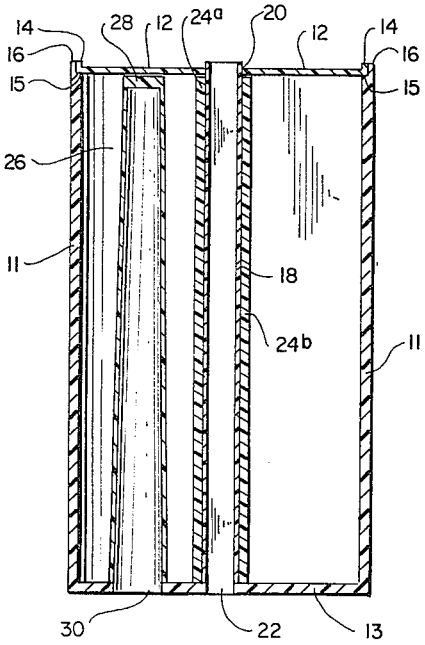
FIG. 2 is a side cross-sectional view taken along lines 2—2 of FIG. 1.

As is more clearly depicted in FIG. 2, an aperture 22 extends through base 13, essentially at its center. A cylindrical conduit 18 is mounted at its lower end around the inner surface of aperture 22. Conduit 18 extends upward through the center of container 10 with its wall being generally straight and substantially parallel to container wall 11, and with its top aperture terminating essential in the plane extending between the top edge 16 of container wall 11.

Conduit 18 preferably maintains an essentially straight configuration and is of a constant interior diameter along its entire length. Thus, primer cup 10 may descend into a borehole by traveling along a detonating cord extending through conduit 18, without becoming lodged or hung up, due to internal conduit draft or detonating cord surface debris.

The wall of conduit 18 is necessarily thin in order to permit the use of relatively low energy detonating cords or blasting caps for initiating detonation of low sensitivity primer material held in container 10.

The explosive energy created by the firing of a detonating cord is determined by its grain weight per foot of cord. As this weight increases, the explosive energy produced by the cord also increases. It is generally desirable to use the lightest possible detonating cord for reasons of cost and ease in handling. The sensitivity of the primer to be detonated is a critical factor in determining the size of detonating cord to be used.

Generally, the sensitivity level of the primer is directly reflective of its cost and the hazards of its handling. Highly sensitive primers are very expensive and very hazardous to handle, while low sensitivity primers are relatively less expensive and less hazardous to handle. Therefore, the general objective is to minimize cost, handling problems, and hazard by using the lowest sensitivity primer producing the necessary detonating pressure, in combination with the lightest possible detonating cord.

Historically, primer cups containing low sensitivity primer materials which are granular, liquid, or moisture sensitive have structurally separated the detonating cord from the primer by an intervening wall surface. Due to structural or manufacture requirements, the intervening wall surface is much thicker than would otherwise be desired. Thus, in order to detonate the primer, the detonating cord must also produce additional energy sufficient to pierce this intervening wall. It has, therefore, been impossible to truly optimize the primer/detonating cord combination due to this intervening wall.

The present invention includes a primer cup 10 having a structurally reinforced thin walled conduit 18 separating the detonating cord from the primer material, such that a low energy detonating cord may be reliably used to initiate detonation of any low sensitivity primer material. Of course, heavier detonating cords and/or more sensitive primer materials may also be effectively utilized in primer cup 10.

One such embodiment of this primer cup 10 has been manufactured of polyethelene. In that embodiment, a detonating cord no larger than 18 grain/foot may be used to reliably detonate low sensitivity primer material through the wall of conduit 18 whose thickness is approximately 30 thousandths of an inch. Further, this polyethelene primer cup 10 has been successfully manufactured, tested, and found structurally adequate with a wall thickness in conduit 18 of less than 20 thousandths of an inch.

Figure 3:
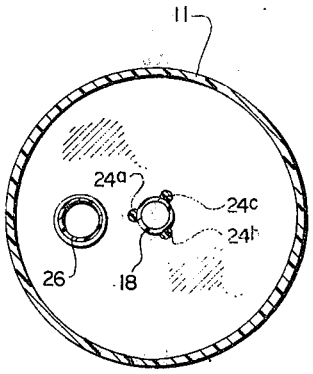
FIG. 3 is a top cross-sectional view taken along lines 3—3 of FIG. 1.

To provide the structural support for the relatively thin wall of conduit 18, columnar ribs 24*a*, 24*b*, and 24*c* (see especially FIGS. 1 and 3) are affixed to and extend peripherally along the outer circumference of conduit 18, parallel to its longitudinal axis. Ribs 24 are integral at their base with the inner face of base 13, their top ends terminating at a position spaced below the top of conduit 18 for a purpose to be hereinafter more fully described. Ribs 24 provide the support necessary to prevent rupturing of the thin wall of conduit 18 by normal rough handling and use, and by stress loading from a detonating cord passing therethrough as primer cup 10 descends into the borehole.

It is desirable, in the illustrated embodiment, to provide a top 12 to enclose the explosive primer within the primer cup 10. Top 12 is a disc-shaped member having an aperture located essentially at its center, coaxial with aperture 22 in base 13 and with conduit 18. Top 12 has an annular flange 14 integrally extending upward around its outer circumference. Flange 14 is constructed to provide a peripheral sealing surface to mate with the cylindrical wall 11 as hereinafter described.

Cylindrical wall 11 has, at its upper end, an annular recess 15 defining a stepped top edge 16. The recess 15 is sized to receive the flange 14 of top 10 in nesting relationship. The top edge 16 projects a sufficient distance to permit the flange 14 to be flush with edge 16 when the top 12 is properly mounted on cylindrical wall 11.

Top 12 is conformably secured over the open end of container 10 by aligning the aperture 20 with the extension of conduit 18 and nesting the top flange 14 so that it uniformly contacts the stepped annular recess 15. The top ends of ribs 24 are positioned so as to provide support for the central portion of top member 12 during the process of sealing it to container 10. Thus, the ribs 24 absorb the loading forces and thereby prevent damage or fracturing in the thin walls of conduit 18.

The aperture 20 positioned near the center of top 12 fits around and in conformable contact with the top end of conduit 18, permitting that conduit to extend through the aperture 20.

The foregoing description relates to structure for effective detonation of low sensitivity explosives with a detonating cord. If desired, low sensitivity explosives may be detonated with an electric blasting cap (EBC). For convenience, structure for incorporating an EBC is also illustrated in the preferred embodiments of FIGS. 1–8. In order to effectively accommodate an EBC, a second aperture 30 extends through base 13 at a position approximately midway between aperture 22 and the outer edge of base 13. Aperture 30 forms the mouth of a second conduit 26 which extends inward through a substantial portion of primer cup 10. The lower end of conduit 26 is integral with and around the inner edge of aperture 30. Conduit 26 is tapered inward from its base at aperture 30 to its top which is closed by top piece 28. The inward taper of conduit 26 forms a frustoconical member whose interior surfaces may be used to frictionally retain an EBC therein.

Conduit 26 extends generally parallel to conduit 18 within container 10. Additionally, both conduits 26 and 18 may be positioned so as to avoid contact with any wall, permitting more complete exposure to the explosive contents of primer cup 10. This positioning of conduits 18 and 26 additionally enhances the efficiency of the molding process by which the primer cup 10 is manufactured.

The walls of conduit 26 are of a similar thickness to those of conduit 18, in order to facilitate the detonation of low sensitivity primer material contained within container 10, for purposes which were more fully described above.

Figure 4:
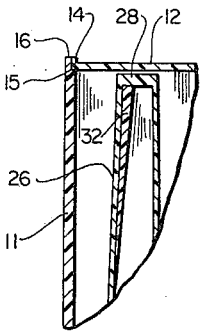
FIG. 4 is an enlarged fragmentary view of a portion of the side cross-sectional view of an alternate embodiment of FIG. 2.

An alternate embodiment of the primer cup 10 is illustrated in FIG. 4, wherein it is seen that the frictional retaining strength of conduit 26 is further increased by the addition of a friction tab or wedge 32, which may be integral with the interior surface of conduit 26 so that its narrow end is directed toward the mouth thereof. With wedge 32 providing frictional retention support, conduit 26 may be constructed in a straight configuration with its internal wall faces being essentially parallel to each other. It is noted that the function of wedge 32 may alternatively be accomplished by such things as flexible pads or adhesive surfaces, and other friction-creating surfaces which are apparent to one of ordinary skill in the art.

Figure 5:
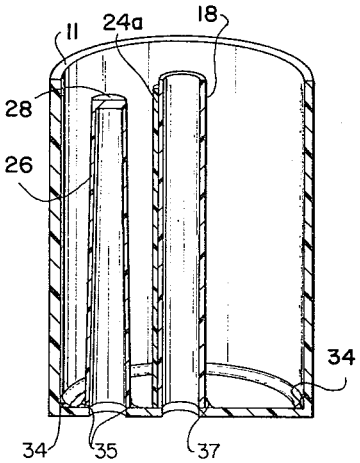
FIG. 5 is a fragmentary perspective view of an alternate embodiment of the primer cup.

An additional alternate embodiment of the primer cup 10 is illustrated in FIG. 5, wherein it is seen that fillets 34, 35, and 37 are integrally included on the base 13 to provide additional structural strength to the corners thereon. More specifically, fillet 34 is integrally positioned along the interior corner between wall 11 and base 13, while fillet 35 is integrally positioned about the entire interior corner between conduit 26 and base 13. Fillet 37 extends integrally along the corner at the intersection of conduit 18 and base 13, but does not extend about the base of ribs 24.

Figure 6:
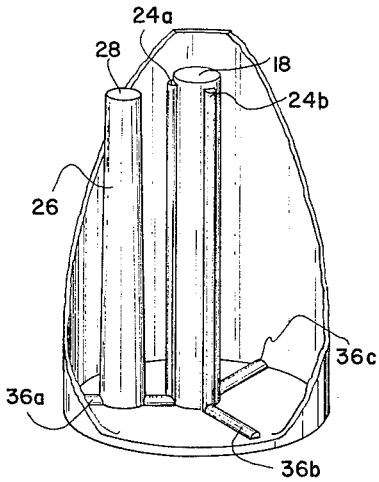
FIG. 6 is a fragmentary perspective view of still another alternate embodiment of the primer cup.

Another alternate embodiment of the primer cup 10 is illustrated in FIG. 6 wherein upward directed flanges 36*a*, 36*b*, and 36*c* constitute primer cup stiffeners. In actual use, after the primer cup 10 has been lowered into a borehole, the miner may give one or more firm tugs on the detonating cord to verify that the primer cup 10 is securely implanted in the surrounding explosive material. If his tug is too strong, it may cause the base 13 to fracture or break and thus permit the contents to spill out. Therefore, to give added support to base 13 and prevent the result described, upward directed flanges 36*a*, 36*b*, and 36*c* are integral along their lower edge with the upper face of base 13, extending radially from an integral connection at their innermost end with ribs 24*a*, 24*b*, and 24*c* to an integral connection at their outermost ends with wall 11. In the alternative, flanges 36*a*, 36*b*, and 36*c* could extend radially outward from an integral connection with conduit 18.

The size of flanges 36*a*, 36*b* and 36*c* required to give adequate support to base 13 is dependent upon the material comprising the base 13 and the flanges 36*a*, 36*b* and 36*c*. For example it has been found that a polyethylene base 13 can be adequately supported in common blasting applications by flanges 36*a*, 36*b* and 36*c* which are approximately 1/6 inch in side to side thickness, and $\frac{3}{8}$ inch to $\frac{1}{2}$ inch high above base 13.

Figure 7:
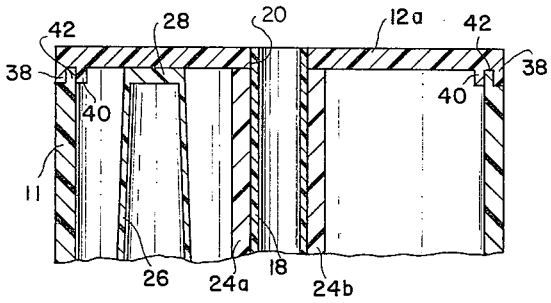
FIG. 7 is an enlarged fragmentary view of a portion of the side cross-sectional view of another alternate embodiment of FIG. 2.

Still another alternate embodiment of the primer cup 10 is shown in FIG. 7 wherein top 41 is a disc-shaped member having an aperture 20 located essentially at its center, coaxial with aperture 22 in base 13 and with conduit 18. Top 12*a* has an annular flange 38 extending downward around its outer circumference. Additionally, another annular flange 40 is integral with top 12*a* and extends downward therefrom parallel to and interior from flange 38, around the entire periphery of top 41. Flanges 38 and 40 are positioned so as to form groove 42 therebetween.

Cylindrical wall 11 has, at its upper end, an annular recess 39 defining a stepped top edge 43 adjacent to the interior surface of wall 11. The recess is sized to receive the flange 38 of top 10 in nesting relationship so that the outer edge of flange 38 is flush with the outer face of wall 11 when the top 12*a* is properly mounted on cylindrical wall 11.

Groove 42 is of a size to receive stepped edge 39 in a nesting relationship so that the adjacent wall surfaces of flanges 38 and 40 are flush with the conforming walls of stepped edge 39.

Top 12*a* is conformably secured over the open end of container 10 by aligning aperture 20 with the extension of conduit 18 and nesting the top flanges 38 and 40 so that they uniformly contact the stepped top edge 43. As with the first primary embodiment disclosed, the top ends of ribs 24 are positioned so as to provide support for the central portion of top 12*a*, thus absorbing the loading forces therefrom to prevent damage or fracturing in the walls of conduit 18.

The aperture 20 positioned near the center of top 41 fits around and in conformable contact with the top end of conduit 18, such that the top end of that conduit is flush with the upper face of top 12*a*.

Figure 8:
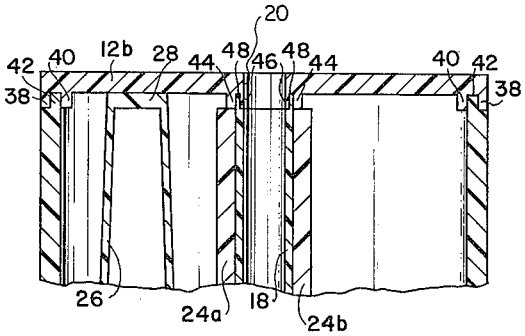
FIG. 8 is an enlarged fragmentary view of a portion of the side cross-sectional view of still another alternate embodiment of FIG. 2.

Referring now to FIG. 8, still another embodiment of the primer cup 10 is shown. Here, it is seen that an annular recess 47 is placed in the inner top end of conduit 18, defining a stepped top edge 45 adjacent to the outer surface of conduit 18. Top 12*b* is identical to top 12*a* of FIG. 7, except that annular flange 46 is integral with top 12*b* and extends downward around the circumference of aperture 20. Another flange, flange 44, is also integral with top 12*b* and extends downward parallel to and at a larger circumference than flange 46.

The adjacent faces of flanges 44 and 46 form a groove 48 which is sized to receive the stepped top edge 45 in nesting relationship. Flange 46 is additionally sized so that it may be positioned in mating relationship with recess 47 and so that its interior peripheral surface is flush with the interior surface of conduit 18.

The top ends of ribs 24 are positioned so as to contact the downward extending end of flange 44 when top 126 is secured over the open end of container 10. Thus, the ribs 24 absorb the loading forces and thereby prevent damage or fracturing in the thin walls of conduit 18.

The alternatives illustrated in FIGS. 7 and 8 and discussed above provide additional contact surfaces between the top member 12, the container walls 18, and the conduit 18, thus increasing the area and security of sealable surfaces between these members.

The primer cup described herein provides for the complete sealing of its contents within the cup to facilitate handling and storage of the contained explosive material. The sealing process is performed after the explosive contents have been placed within container 10, and with top 12 in its closed position, as above-described.

With cup 10 retained in a secured position, an ultrasonic vibrator is placed in contact with top 12. The vibrator is then pressed downward upon top 12 so as to force its outer edge and flange 14 firmly against recess 15. The top ends of ribs 24 provide support for the center of top 12, defining its sealed position. The loading forces resulting from the applied pressure to the center portion of top 12 are transmitted through the thin walls of conduit 18 to supporting ribs 24, preventing damage or cracking in the frangible conduit 18.

Ultrasonic vibrations are next applied directly onto top 12, causing high frequency frictional rubbing against all conformably connected surfaces. The high frequency friction causes heating between the conformable surfaces which, over a short period of time, causes their bonding together. The bonding of the surfaces results in a complete and liquid impermeable sealing of top 12 to container sidewalls 11 and conduit 18, preventing the outward transmission of the aqueous contents of container 10. This seal permits the primer cup to act as a moisture impervious barrier for protecting moisture sensitive primer materials within primer cup 10 from exposure to external moisture.

It will be appreciated that top 12 could alternatively be sealed to primer cup 10 by welding, bonding, solvent sealing, or other methods which are apparent to one of ordinary skill in the art.

The primer described herein may be easily manufactured by an injection molding process, although its method of manufacture clearly is not limited to this process. Presently preferred materials for use in colder areas are polyolefins, polyetylene, polypropylene, and polybutylene, due to their desirable low temperature strength characteristics. In warmer temperature applications, impact-resistant polystyrene will perform adequately. These materials are given by way of example only, as it is appreciated that there are a large number of materials including admixtures and copolymers which could provide desirable results in this design.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A primer cup for containing explosives comprising:
a cylindrical container;
a sealable top member which is initially removable to permit introduction of said explosives into said container;
a first conduit having thin wall construction extending through said container between the ends thereof with apertures at each end for providing a passage therethrough;
means attached to said first conduit for providing structural support thereto;
a second conduit having thin wall construction extending into said container from one end only, with an end piece capping its internal end and with an aperture at its mouth end, said second conduit providing a chamber for the positioning and retaining of blasting caps adjacent to said container contents;
means for sealing said sealable top member to said cylindrical container, said sealing means comprising:
a first downwardly extending flange positioned upon and completely around the outer circumference of said sealable top member;
a second downwardly extending flange positioned upon said top member so as to be interior from and parallel to said first downwardly extending flange with the adjacent edges of said first and second flanges forming a first groove therebetween;
a stepped top edge which extends around the entire top of said container, so as to conformably attach to said first groove in a nesting relationship.

2. A primer cup as defined in claim 1 wherein said sealable top member contains an aperture therein corresponding in contour to the circumference of said first conduit for permitting the extension of said first conduit therethrough while permitting a sealable connection between the outer surface of said first conduit means and said top member aperture.

3. A primer cup as defined in claim 1 wherein, with said stepped top edge of said container and said first groove in a nesting relationship, the outer side of said first downward extending flange is essentially flush with the outer wall surface of said container.

4. A primer cup as defined in claim 1 wherein said sealing means additionally comprises:
an aperture in said sealable top member corresponding in contour to the circumference of said first conduit;
a third downwardly extending flange positioned upon and completely around the periphery of said aperture;
a fourth downwardly extending flange positioned upon said top member so as to be parallel to said third downwardly extending flange with a somewhat larger circumference than said third flange so that the adjacent edges of said third and fourth flanges form a second groove therebetween; and
a stepped top edge which extends around the entire top of said first conduit so as to conformably attach to said second groove in a nesting relationship.

5. A primer cup as defined in claim 4 wherein, with said stepped top edge of said conduit and said second groove in a nesting relationship, the inward most edge of said third downward extending flange is essentially flush with the inner wall surface of said first conduit.

6. A primer cup as defined in claim 1 wherein said first conduit is substantially cylindrical in construction, extending in a straight configuration with a constant interior diameter along its entire length.

7. A primer cup as defined in claim 1 wherein said second conduit means is frustoconical in construction, being inwardly tapered from its aperture to its closed end.

8. A primer cup as defined in claim 4 wherein said second conduit additionally comprises a friction member secured to the upper interior wall surface of said second conduit for providing additional ability to frictionally retain objects placed within said second conduit.

9. A primer cup as defined in claim 1 wherein the walls of said first and second conduit means are of a thickness which will permit the detonation of a primer of low sensitivity held within said container, by the explosion of a low energy detonating cord, positioned within said first or second tubular means.

10. A primer cup as defined in claim 9 wherein said first and second conduit means are neither in contact with nor immediately adjacent to any walls.

11. A primer cup as defined in claim 9 wherein said structural support means comprises one or more rib members affixed to and extending longitudinally along a substantial portion of the exterior surface of said first conduit, comprising support columns for that member.

12. A primer cup as defined in claim 1 wherein said second conduit additionally comprises a friction member secured to the upper interior surface of said second conduit for improving ability to frictionally retain objects placed therein.

13. A primer cup as defined in claim 1 wherein said cup is constructed by a process of injection molding with the use of materials susceptible to this process including but not limited to polyolefins and polystyrene.

14. A primer cup as defined in claim 1 additionally comprising first reinforcing means for providing structural support between the base of said container and all members which intersect therewith.

15. A primer cup as defined in claim 14 wherein said first reinforcing means comprises fillets which extend over and are integral with the corners formed by the intersection of:
the cylindrical wall of said container and the base of said container;
the bottom end of said first conduit and the base of said container; and
the bottom end of said second conduit and the base of said container.

16. A primer cup as defined in claim 1 additionally comprising second reinforcing means connected to the base of said container for providing structural support thereto.

17. A primer cup as defined in claim 16 wherein said second reinforcing means comprises plural upward extending flanges which are integral along their base with the upper face of the base of said container, and extend radially outward from an integral connection with the base of said structural support means to an integral connection with the internal base of said container wall.

18. A primer cup as defined in claim 1 additionally comprising plural upward extending flanges which are integral along their base with the upper face of the base of said container and extend radially outward from an integral connection with the base of said first conduit to an integral connection with the internal base of said container wall, for providing additional structural support to the base of said container.

19. A primer cup as defined in claim 1 wherein said explosives are comprised of granular, aqueous or liquid materials.

20. A primer cup as defined in claim 1 wherein said primer cup comprises a moisture impervious barrier for protecting moisture sensitive explosive materials contained therein from exposure to external moisture.

21. The primer cup for use in containing and detonating explosives comprising:

a cylindrical container having a sealable top end which is removable until sealed to said container;

an aperture positioned substantially in the center of said top end;

sealing means for securing said sealable top end to said container said sealing means comprising:

a first downwardly extending flange positioned upon and completely around the outer circumference of said sealable top member;

a second downwardly extending flange positioned upon said top member so as to be interior from and parallel to said first downwardly extending flange with the adjacent edges of said first and second flanges forming a first groove therebetween;

a stepped top edge which extends around the entire top of said container so as to conformably attach to said first groove in a nesting relationship;

a substantially cylindrical tubular conduit having a fixed internal diameter throughout and extending in straight configuration upward from an aperture in the bottom end of said container, with the said bottom end aperture comprising its lower mouth, said conduit being positioned so as to avoid contact with any other conduit or container wall, said cylindrical conduit additionally comprising conduit walls of a thickness which will permit the detonation of low sensitivity primers held within said container by the explosion of a detonating cord positioned within said cylindrical conduit;

a frustoconical tubular conduit extending upward in a tapered contour from an aperture comprising its mouth in the bottom end of said container to a smaller diameter end piece substantially near the top end of said container, all other outside surfaces of said frustoconical conduit avoiding contact with any other surface, said frustoconical conduit additionally comprising shaft walls of substantially similar thickness to those of said cylindrical conduit; and a plurality of essentially columnar-shaped ribs positioned symmetrically about and attached to said cylindrical conduit so as to extend longitudinally along the outer surface of said cylindrical conduit from the aperture thereof upward to a termination point approximately adjacent to the lower face plane of the sealable top end of said primer cup.

22. A primer cup as defined in claim 21 wherein said cylindrical tubular conduit extends upward through said top end aperture so that the outer surface of said cylindrical conduit is in mating contact with the inner edge of said aperture about its entire periphery.

23. A primer cup as defined in claim 21 wherein, with said stepped top edge of said container and said first groove in a nesting relationship, the outer side of said first downward extending flange is essentially flush with the outer wall surface of said container.

24. A primer cup as defined in claim 21 wherein said sealing means additionally comprises:

an aperture in said sealable top member corresponding in contour to the circumference of said first conduit;

a third downwardly extending flange positioned upon and completely around the periphery of said aperture;

a fourth downwardly extending flange positioned upon said top member so as to be parallel to said third downwardly extending flange with somewhat a larger circumference than said third flange so that the adjacent edges of said third and fourth flanges form a second groove therebetween; and a stepped top edge which extends around the entire top of said first conduit so as to conformably attach to said second groove in a nesting relationship.

25. A primer cup as defined in claim 24 wherein, with said stepped top edge of said conduit and said second groove in a nesting relationship, the inward most edge of said third downward extending flange is essentially flush with the inner wall surface of said first conduit.

26. A primer cup as defined in claim 21 wherein said frustoconical conduit additionally comprises a friction member secured to the upper interior wall surface of said frustoconical conduit for providing additional ability to frictionally retain objects placed therein.

27. A primer cup as defined in claim 26 wherein said frustoconical conduit is a substantially cylindrical conduit having a fixed internal diameter throughout and extending in a straight configuration upward from said aperture to said end piece.

28. A primer cup as defined in claim 21 additionally comprising fillets which extend over and are integral with the corners formed by the intersection of the cylindrical wall of said container and the base of said container, the bottom end of said cylindrical conduit and the base of said container, and the bottom end of said frustoconical conduit and the base of said container for providing additional structural support at those locations.

29. A primer cup as defined in claim 21 additionally comprising plural upward extending flanges which are integral along their base with the upper face of the base of said container, and extend radially outward from an integral connection with the base of said columnar-shaped ribs to an integral connection with the internal base of said container wall for providing additional structural support to the base of said container.

30. A primer cup as defined in claim 21 additionally comprising plural upward extending flanges which are integral along their base with the upper face of the base of said container, and extend radially outward from an integral connection with the base of said cylindrical conduit to an integral connection with the internal base of said container wall, for providing additional structural support to the base of said container.

31. A primer cup as defined in claim 21 wherein said explosives are comprised of granular, aqueous or liquid materials.

32. A primer cup as defined in claim 21 wherein said primer cup comprises a moisture impervious barrier for protecting moisture sensitive explosive materials contained therein from exposure to external moisture.

* * * * *